US007559447B2

(12) United States Patent
Chen et al.

(10) Patent No.: US 7,559,447 B2
(45) Date of Patent: Jul. 14, 2009

(54) NAIL-DRIVING DEVICE WITH SAFETY UNIT

(75) Inventors: Chun-Chiang Chen, Taichung (TW); Jing-Chi Chen, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 12/069,847

(22) Filed: Feb. 12, 2008

(65) Prior Publication Data

US 2008/0197165 A1 Aug. 21, 2008

(30) Foreign Application Priority Data

Feb. 15, 2007 (TW) ..... 96105729 A

(51) Int. Cl.
*B25C 1/04* (2006.01)

(52) U.S. Cl. ..... 227/8; 227/130

(58) Field of Classification Search ..... 227/8, 227/10, 130, 120, 142
See application file for complete search history.

(56) References Cited

U.S. PATENT DOCUMENTS 5,551,621 A * 9/1996 Vallee ..... 227/8
5,593,079 A * 1/1997 Mukoyama et al. ..... 227/8
5,715,982 A * 2/1998 Adachi ..... 227/8
5,785,227 A * 7/1998 Akiba ..... 227/8
5,836,501 A * 11/1998 Lai ..... 227/8
6,024,267 A * 2/2000 Chen ..... 227/8
6,059,161 A * 5/2000 Chang et al. ..... 227/8
6,170,729 B1 * 1/2001 Lin ..... 227/8
6,186,386 B1 * 2/2001 Canlas et al. ..... 227/142
6,213,372 B1 * 4/2001 Chen ..... 227/8
6,578,750 B2 * 6/2003 Kubo et al. ..... 227/142
6,929,165 B1 * 8/2005 Chen et al. ..... 227/8
7,140,524 B2 * 11/2006 Hung et al. ..... 227/8

* cited by examiner

*Primary Examiner*—Scott A. Smith
(74) *Attorney, Agent, or Firm*—Townsend and Townsend and Crew, LLP

(57) ABSTRACT

A nail-driving device includes a housing, a trigger unit operable to fire a nail from the housing, and a resilient member disposed between first and second safety members. When a workpiece-engaging end of the first safety member is pressed against a workpiece such that a tip of the nail is moved into a nail hole in the workpiece, the first safety member pushes and moves the resilient member and the second safety member toward the trigger unit along a longitudinal direction until a stop-engaging portion and a trigger-engaging portion of the second safety member come into contact with a stop portion of the housing and the trigger unit, respectively, thereby preventing further movement of the second safety member along the longitudinal direction while allowing for movement of the first safety member toward the second safety member against the biasing action of the resilient member.

7 Claims, 6 Drawing Sheets

NAIL-DRIVING DEVICE WITH SAFETY UNIT

CROSS-REFERENCES TO RELATED APPLICATIONS

This application claims priority to Taiwanese Application No. 096105729, filed Feb. 15, 2007, the disclosure of which is herein incorporated by reference.

BACKGROUND OF THE INVENTION

1. Field of the Invention

This invention relates to a nail-driving device, and more particularly to a nail-driving device that includes a safety unit.

2. Description of the Related Art

Referring to FIGS. 1 and 2, a conventional nail-driving device 1 includes a nail ejection seat 11, a safety member 12 movable relative to the nail ejection seat 11 in a nail-driving direction, a magazine 14 connected to the nail ejection seat 11 for receiving a plurality of nails 13, and a trigger unit 15 operable to fire the nails 13 from the nail ejection seat 11 one at a time. The safety member 12 has a pressing portion 121 movable within the nail ejection seat 11, and a contact portion 122 movable to contact the trigger unit 15 so as to allow for firing of one nail 13. If the contact portion 122 of the safety member 12 is not in contact with the trigger unit 15, any operation of the trigger unit 15 cannot result in firing of one nail 13. One of the nails 13 is disposed within the nail ejection seat 11, and has a tip 131 protruding farther from the nail ejection seat 11 along the nail-driving direction than the pressing portion 121 of the safety member 12.

To fasten a workpiece 2 in the form of a metal plate onto a wooden member (not shown), such as a wooden plate, one or more nails 13 are moved respectively through nail holes 21 (only one is shown) in the workpiece 2, and are driven into the wooden member. During a nail-driving operation of the nail-driving device 1, the pressing portion 121 of the safety member 12 is pressed against the workpiece 2 to move the nail 13 into the corresponding nail hole 21 in the workpiece 2. Hence, the contact portion 122 of the safety member 12 comes into contact with the trigger unit 15 to switch the nail-driving device 1 to a firing-allowable state. Subsequently, the trigger unit 15 is operated to drive the nail 13 into the wooden member.

The aforesaid conventional nail-driving device 1 has a drawback. That is, the maximum distance traveled by the safety member 12 relative to the nail 13 is limited. Thus, if the workpiece 2 is thick, for example, if the thickness of the workpiece 2 is about 4.5 mm, when the safety member 12 is pressed against the workpiece 2 and when the nail 13 is moved into the corresponding nail hole 21 in the workpiece 2, the nail 13 may not be able to contact the wooden member. If this occurs, when the nail 13 is driven into the wooden member by the nail-driving device 1, the portion of the nail 13 extending into the wooden member will be too short to fasten the workpiece 2 firmly to the wooden member.

SUMMARY OF THE INVENTION

The object of this invention is to provide a nail-driving device that includes a safety unit and that is suitable for a thick workpiece having a thickness of about 4.5 mm.

According to this invention, a nail-driving device includes a housing, a trigger unit operable to fire a nail from the housing, and a resilient member disposed between first and second safety members. When a workpiece-engaging end of the first safety member is pressed against a workpiece such that a tip of the nail is moved into a nail hole in the workpiece, the first safety member pushes and moves the resilient member and the second safety member toward the trigger unit along a longitudinal direction until a stop-engaging portion and a trigger-engaging portion of the second safety member come into contact with a stop portion of the housing and the trigger unit, respectively, thereby preventing further movement of the second safety member along the longitudinal direction while allowing for movement of the first safety member toward the second safety member against the biasing action of the resilient member.

Since the first safety member is movable relative to the second safety member, the maximum distance traveled by the first safety member relative to the nail is increased significantly. Therefore, the nail-driving device of this invention can be used for fastening a thick workpiece to a wooden member.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
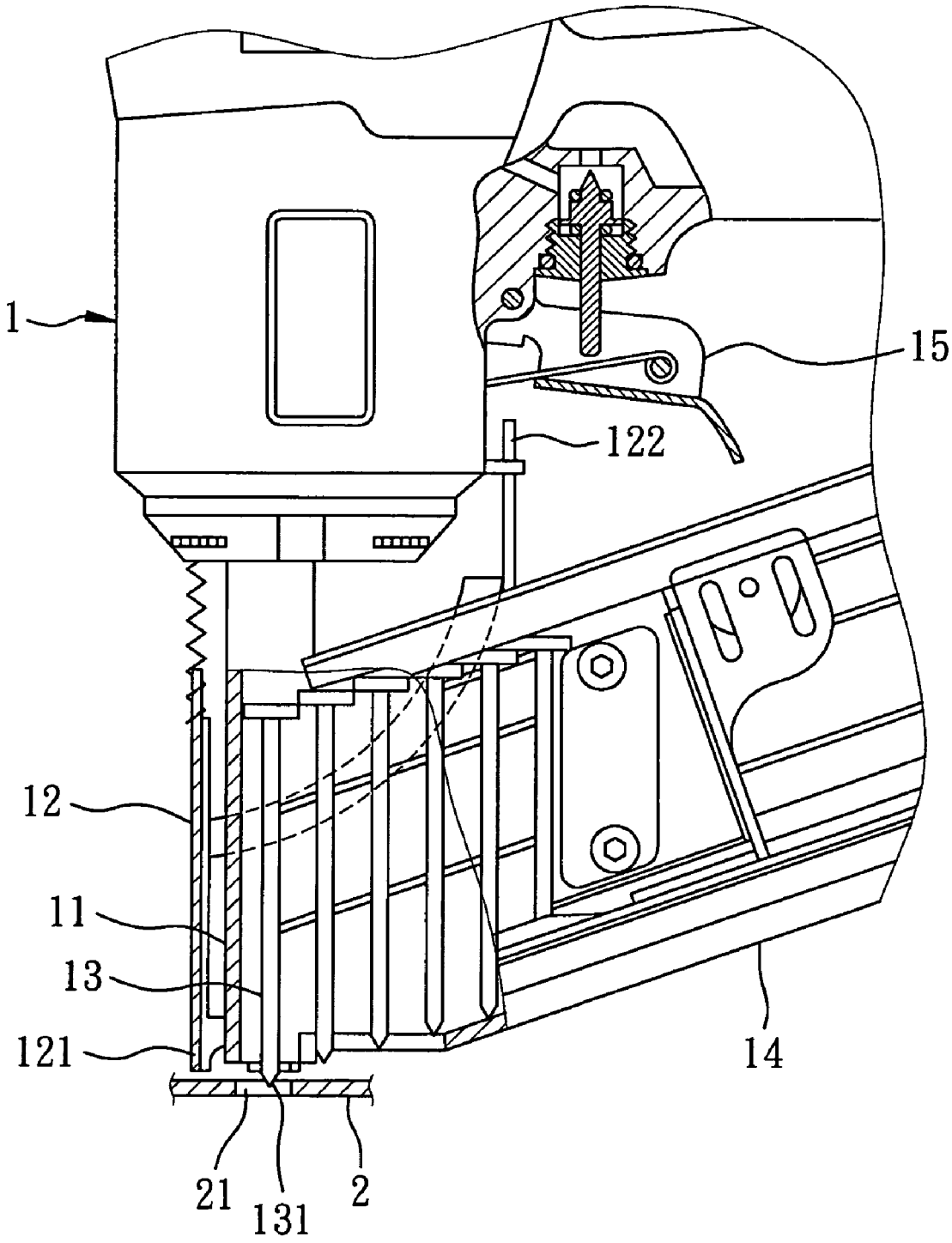
FIG. 1 PRIOR ART
FIG. 1 is a fragmentary schematic sectional view of a conventional nail-driving device.
Figure 2:
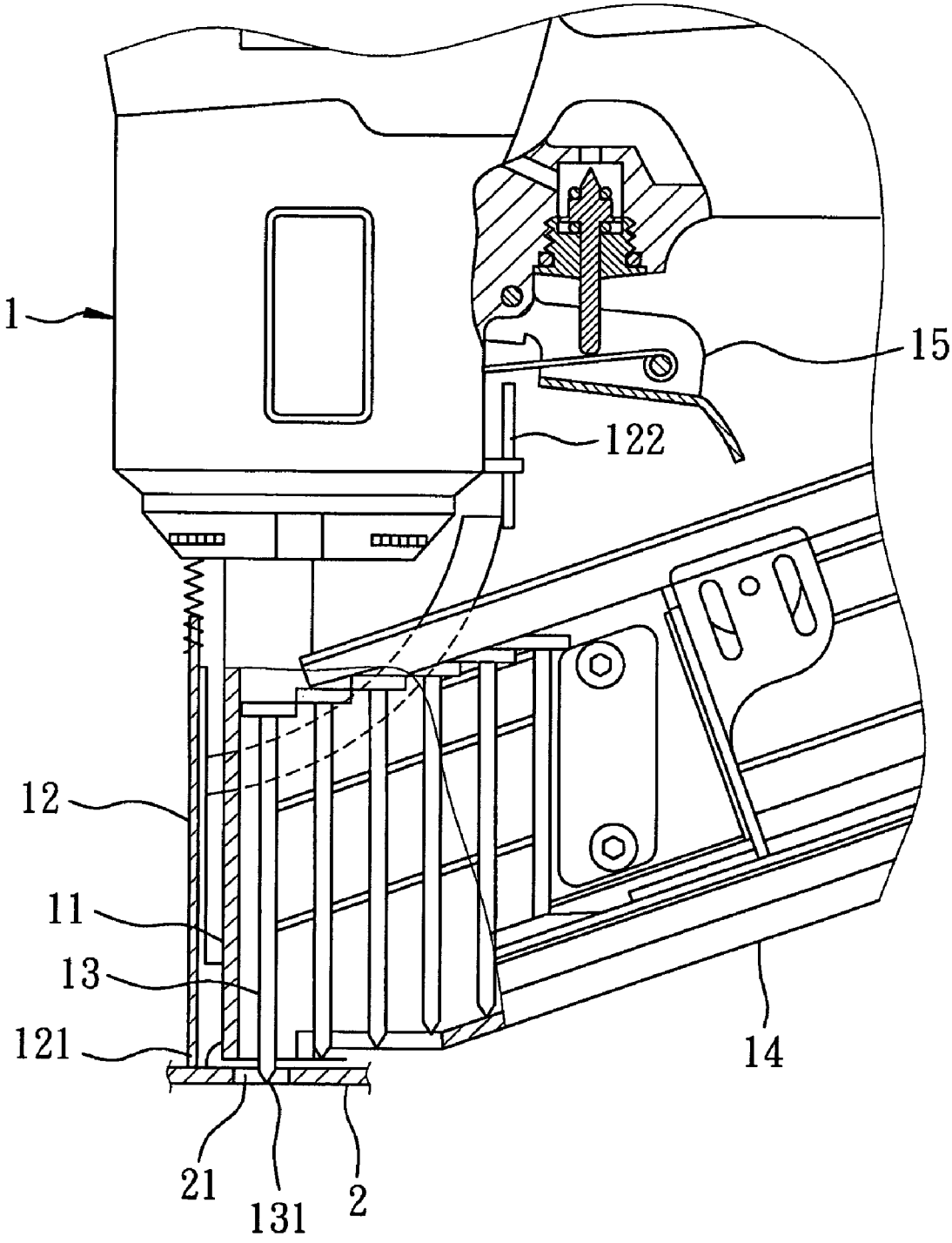
FIG. 2 PRIOR ART
FIG. 2 is a fragmentary schematic sectional view of the conventional nail-driving device, illustrating movement of a safety member.
Figure 3:
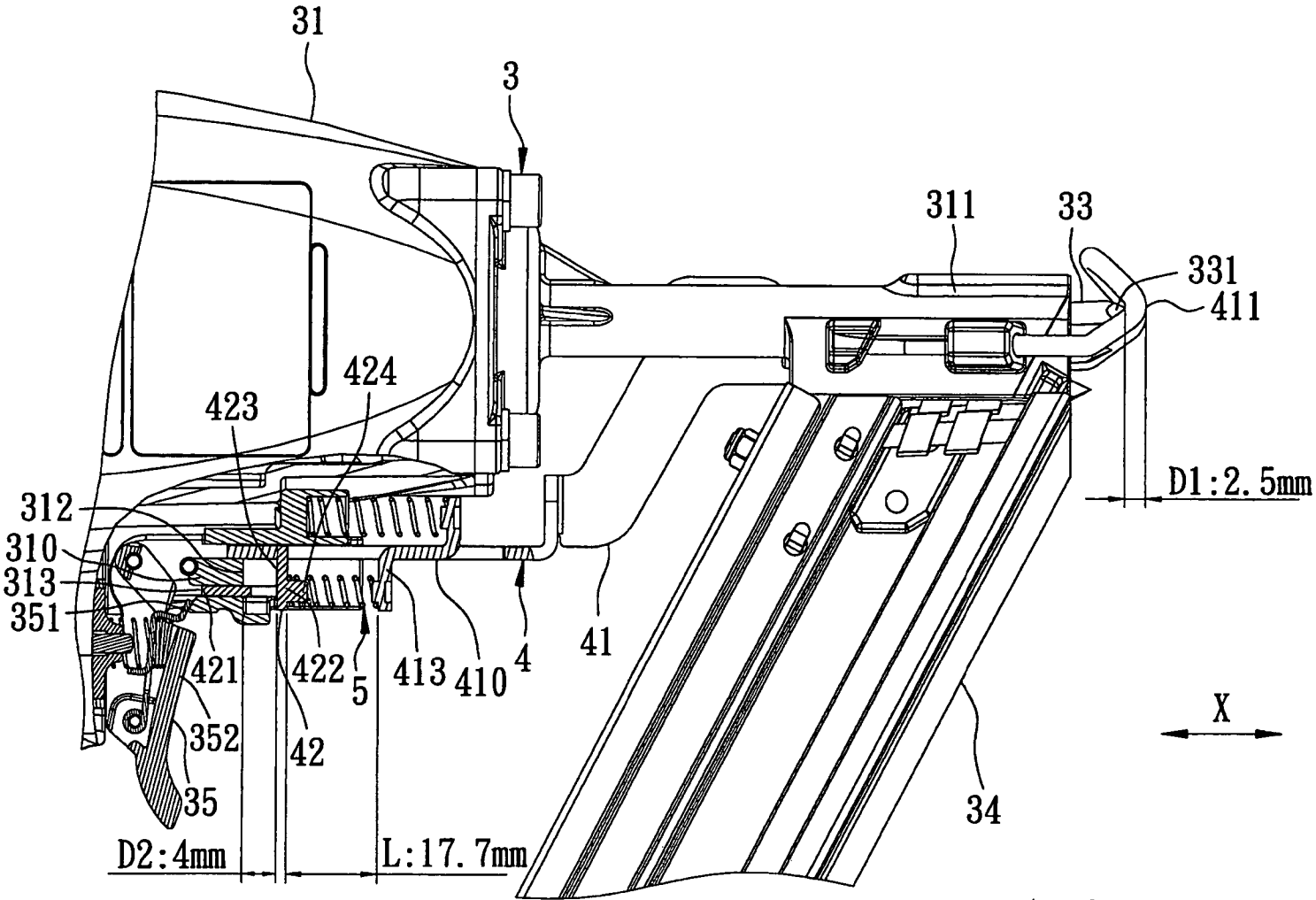
FIG. 3 is a fragmentary front view of the preferred embodiment of a nail-driving device according to this invention in a state where firing of a nail is prevented.
Figure 4:
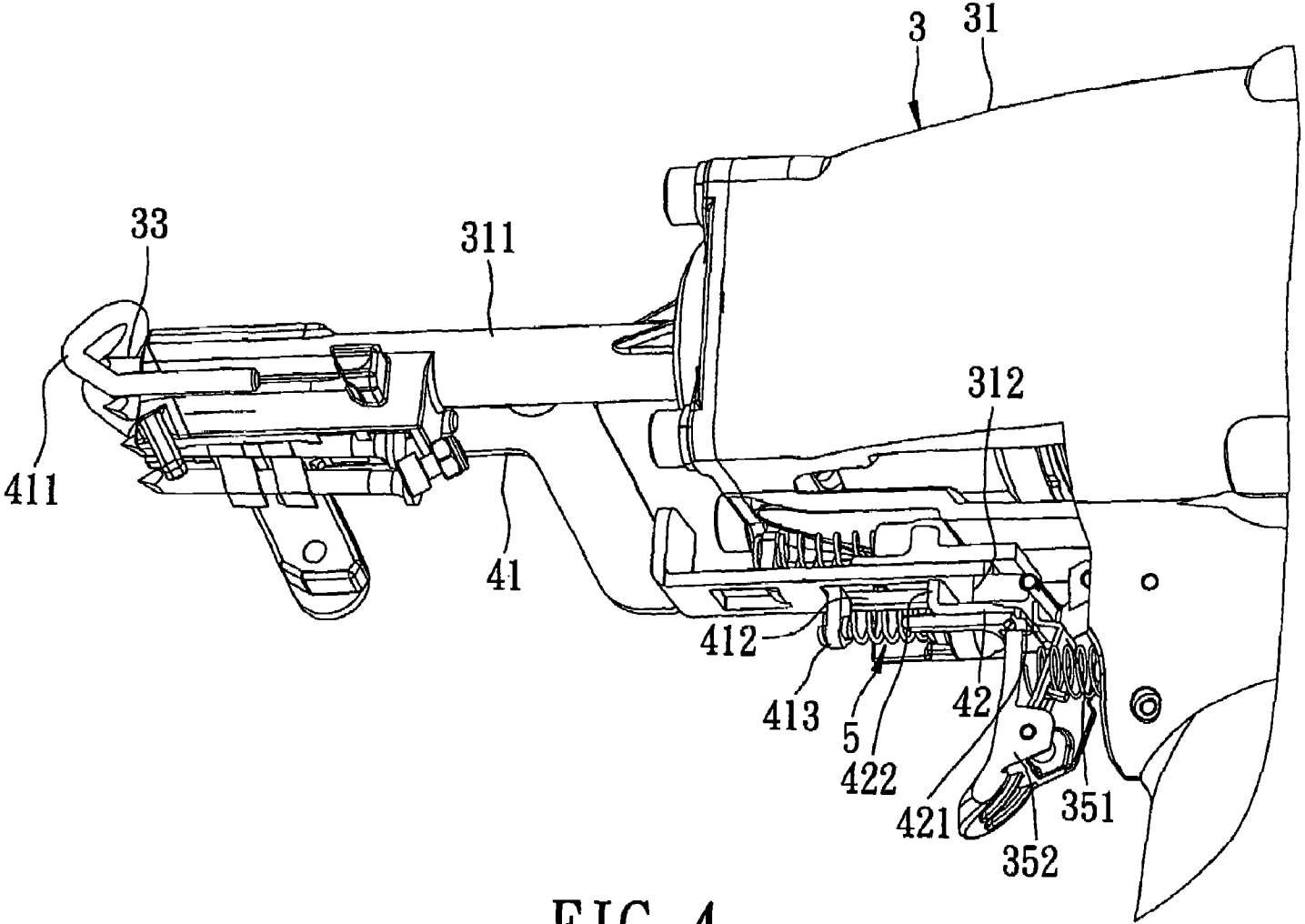
FIG. 4 is a fragmentary perspective view of the preferred embodiment.

Referring to FIGS. 3 and 4, the preferred embodiment of a nail-driving device 3 according to this invention includes a housing 31, a magazine 34 connected to the housing 31 for receiving a plurality of nails 33, and a trigger unit 35. The housing 31 includes a spacer member 310, and a nail ejection seat 311 in spatial communication with the magazine 34. The spacer member 310 has an outer wall surface or stop portion 312, and a guide hole 313 formed therethrough and extending from the stop portion 312 toward the trigger unit 35. Each of the nails 33 has a tip 331. One of the nails 33 is disposed in the nail ejection seat 311, and is referred to as "the nail" hereinafter. The trigger unit 35 includes a trigger arm 351 and a trigger 352. The nail-driving device 3 further includes a control device consisting of a safety unit 4 and a resilient member 5.

The safety unit 4 includes a first safety member 41 and a second safety member 42 that are movable relative to the housing 31 along a longitudinal direction (X). The first safety member 41 has a workpiece-engaging end 411 and a limiting slot 412. The limiting slot 412 is formed therethrough an end of the first safety member 41 opposite to the workpiece-engaging end 411, and has two closed ends and a length (L) of 17.7 mm. In this embodiment, the first safety member 41 has a main plate portion 410 extending along the longitudinal direction (X) and formed with the limiting slot 412, and a spring-engaging plate portion 413 extending perpendicularly from the main plate portion 410. The workpiece-engaging end 411 of the first safety member 41 projects farther from the nail ejection seat 311 than the tip 331 of the nail 33, and is spaced apart from the tip 331 of the nail 33 by a first distance (D1) of 2.5 mm. The first distance (D1) may be greater than 2.5 mm. The second safety member 42 has a trigger-engaging portion 421 and a stop-engaging portion 422 disposed respectively at two ends thereof. The outer wall surface 312 (i.e., the stop portion) faces the second safety member 42.

Figure 5:
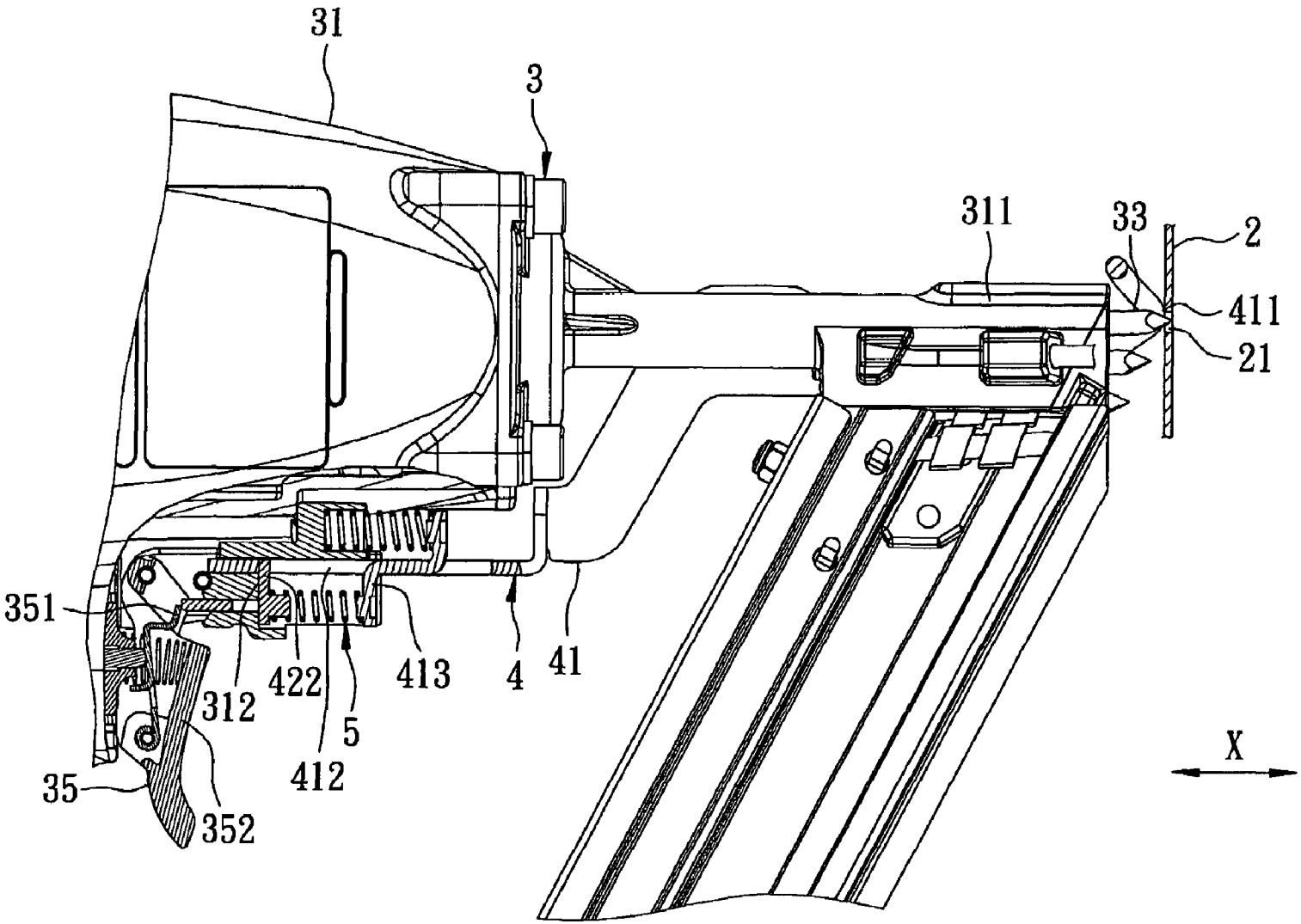
FIG. 5 is a fragmentary sectional view of the preferred embodiment in a state of use with a thin workpiece, illustrating how firing of the nail is allowed.

The trigger-engaging portion 421 is configured as a sliding rod, and is disposed movably within the guide hole 313 in the spacer member 310 for guiding movement of the second safety member 42 along the longitudinal direction (X) to contact the free end of the trigger arm 351 of the trigger unit 35 with the trigger-engaging portion 421. The trigger arm 351 and the trigger 352 of the trigger unit 35 are connected to the housing 31 in a known manner such that, if the trigger-engaging portion 421 of the second safety member 42 is spaced apart from the free end of the trigger arm 351, as shown in FIG. 3, firing of the nail 33 can be prevented when the trigger 352 is pressed, and if the trigger-engaging portion 421 of the second safety member 42 is in contact with the free end of the trigger arm 351, as shown in FIG. 5, the trigger 352 can be pressed to fire the nail 33.

The stop-engaging portion 422 of the second safety member 42 has a spring-engaging plate portion 423 and a longitudinal rod portion 424 extending perpendicularly from the spring-engaging plate portion 423 along the longitudinal direction (X). The spring-engaging plate portion 423 extends into the limiting slot 412 in the first safety member 41 along a direction perpendicular to the longitudinal direction (X) so as to limit a distance traveled by the first safety member 41 relative to the second safety member 42 along the longitudinal direction (X). When the trigger-engaging portion 421 of the second safety member 42 is in contact with the free end of the trigger arm 351, the spring-engaging plate portion 423 abuts against the stop portion 312. When the nail-driving device 3 is not in use, the spring-engaging plate portion 423 is spaced apart from the stop portion 312 of the housing 31 by a second distance (D2) of 4 mm. The second distance (D2) may be smaller than 4 mm.

The resilient member 5 is disposed between the spring-engaging plate portions 413, 423 of the first and second safety members 41, 42 for biasing the first and second safety members 41, 42 to move away from each other along the longitudinal direction (X). In this embodiment, the resilient member 5 is configured as a coiled compression spring, and is sleeved on the longitudinal rod portion 424 of the second safety member 42, and has two ends abutting respectively against the spring-engaging plate portions 413, 423 of the first and second safety members 41, 42.

Since the workpiece-engaging end 411 of the first safety member 41 protrudes farther from the nail ejection seat 311 than the tip 331 of the nail 33, when the workpiece-engaging end 411 of the first safety member 41 is in contact with a workpiece 2 (see FIG. 5) and when the resilient member 5 is not compressed (i.e., no external force is applied to press the nail-driving device 3 against the workpiece 2), the tip 331 of the nail 31 is spaced apart from the workpiece 2.

With particular reference to FIG. 5, in a situation where the thickness of the workpiece 2 is 1.5 mm, to drive the nail 33 into an object (not shown), such as a wooden plate, which abuts against the workpiece 2, the tip 331 of the nail 33 is first registered with a nail hole 21 in the workpiece 2. Next, the workpiece-engaging end 411 of the first safety member 41 is pressed against the workpiece 2. Hence, the tip 331 of the nail 33 is moved into the nail hole 21 in the workpiece 2 until it comes into contact with the object. At the same time, the spring-engaging plate portion 413 of the first safety member 41 pushes and moves the resilient member 5 and the second safety member 42 toward the trigger unit 35 a distance of 4 mm along the longitudinal direction (X), which is equal to the sum of the first distance (D1) and the thickness of the workpiece 2. Since the second distance is 4 mm, when the tip 331 of the nail 33 comes into contact with the object, the trigger-engaging portion 421 and the stop-engaging portion 422 of the second safety member 42 come into contact with the free end of the trigger arm 351 and the stop portion 312, respectively, thereby preventing further movement of the second safety member 42 along the longitudinal direction (X) while allowing the nail 33 to be driven into the object when the trigger 352 is pressed.

Figure 6:
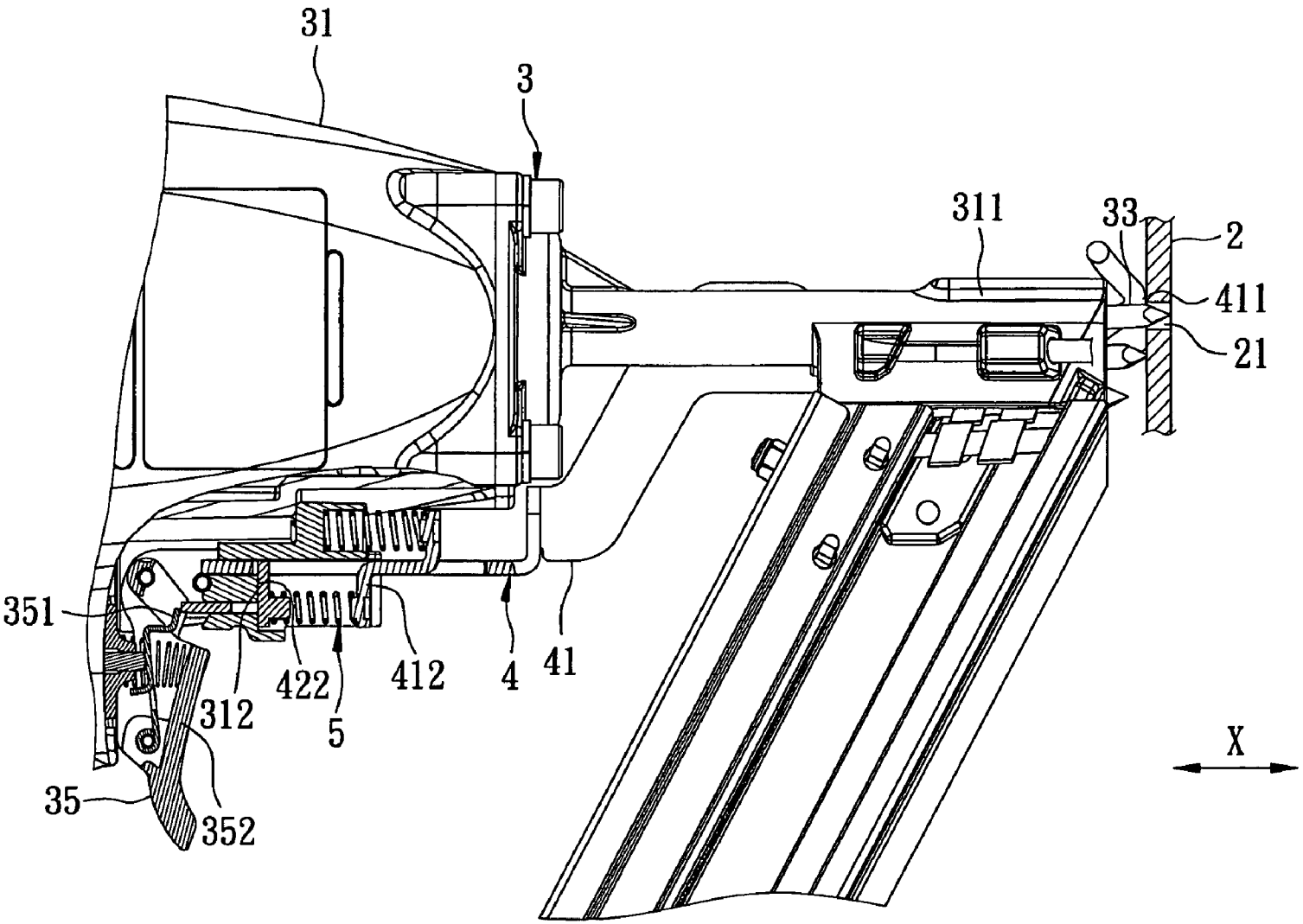
FIG. 6 is a fragmentary sectional view of the preferred embodiment in a state of use with a thick workpiece, illustrating how firing of the nail is allowed.

With particular reference to FIG. 6, in a situation where the thickness of the workpiece 2 is 4.5 mm, when the tip 331 of the nail 33 is aligned with the nail hole 21 in the workpiece 2, and when the workpiece-engaging end 411 of the first safety member 41 is pressed against the workpiece 2, the tip 331 of the nail 33 is moved through the nail hole 21 in the workpiece 2 to thereby contact the object, and the first safety member 41 pushes and moves the resilient member 5 and the second safety member 42 toward the trigger unit 35 along the longitudinal direction (X). When the trigger-engaging portion 421 and the stop-engaging portion 422 of the second safety member 42 come into contact with the free end of the trigger arm 351 and the stop portion 312, respectively, the resilient member 5 is compressed so as to allow for movement of the first safety member 41 toward the second safety member 42 against the biasing action of the resilient member 5. As such, the second safety member 42 is moved a distance of 4 mm, and the first safety member 41 is moved a distance of 7 mm, which is equal to the sum of the first distance (D1) and the thickness of the workpiece 2.

In view of the above, since the first safety member 41 is movable toward the second safety member 42 after the trigger-engaging portion 421 of the second safety member 42 contacts the free end of the trigger arm 351, the maximum distance traveled by the nail 33 relative to the first safety member 41 is long. Thus, the nail-driving device 3 of this invention is suitable for a thick workpiece 2 of 4.5 mm.

With this invention thus explained, it is apparent that numerous modifications and variations can be made without departing from the scope and spirit of this invention. It is therefore intended that this invention be limited only as indicated by the appended claims.

We claim:

1. A nail-driving device adapted for use with a nail and a workpiece formed with a nail hole therethrough, said nail-driving device comprising:

a housing having a stop portion;

a trigger unit disposed on said housing;

a safety unit including a first safety member having a workpiece-engaging end adapted to press against a workpiece, and a second safety member spaced apart from said stop portion and having a trigger-engaging portion, said trigger-engaging portion of said second safety member being movable to contact said trigger unit so that said trigger unit is operable to fire the nail; and a resilient member disposed between said first and second safety members for biasing said first and second safety members to move away from each other along a longitudinal direction;

wherein, when said workpiece-engaging end of said first safety member is pressed against the workpiece such that the nail is moved into the nail hole in the workpiece, said first safety member pushes and moves said resilient member and said second safety member toward said trigger unit along said longitudinal direction until said trigger-engaging portion of said second safety member comes into contact with said trigger unit, such that said stop portion can prevent further movement of said second safety member along said longitudinal direction while allowing for movement of said first safety member moves toward said second safety member against the biasing action of said resilient member.

2. The nail-driving device as claimed in claim 1, wherein said resilient member is configured as a coiled compression spring, and has two ends abutting against said first and second safety members.

3. The nail-driving device as claimed in claim 1, wherein said housing includes a spacer member disposed between said second safety member and said trigger unit, said spacer member being formed with a guide hole formed therethrough, said trigger-engaging portion of said second safety member being configured as a sliding rod disposed movably within said guide hole in said spacer member for guiding movement of said second safety member along said longitudinal direction to contact said trigger unit.

4. The nail-driving device as claimed in claim 3, wherein said second safety member of said safety unit further has a stop-engaging portion co-movable with said trigger-engaging portion, said stop-engaging portion coming into contact with said stop portion of said housing when said trigger-engaging portion comes into contact with said trigger unit.

5. The nail-driving device as claimed in claim 4, wherein said spacer member has an outer wall surface adapted to face said second safety member and constituting said stop portion of said housing, said guide hole extending from said outer wall surface toward said trigger unit, said stop-engaging portion of said second safety member having a plate portion that abuts against said outer wall surface of said spacer member when said trigger-engaging portion of said second safety member comes into contact with said trigger unit.

6. The nail-driving device as claimed in claim 5, wherein said workpiece-engaging end of said first safety member is adapted to project farther from said housing than a tip of the nail, and is adapted to be spaced apart from a tip of the nail by a first distance along said longitudinal direction when said resilient member is not compressed, said first distance being no smaller than 2.5 mm, said spring-engaging plate portion of said second safety member being spaced apart from said outer wall surface of said spacer member by a second distance that is no greater than 4 mm.

7. The nail-driving device as claimed in claim 4, wherein:

said first safety member has a main plate portion extending along said longitudinal direction, a limiting slot formed through said main plate portion and having two closed ends, and a spring-engaging plate portion extending perpendicularly from said main plate body;

said stop-engaging portion of said second safety member has a spring-engaging plate portion extending into said limiting slot in said first safety member along a direction perpendicular to said longitudinal direction so as to limit a distance traveled by said first safety member relative to said second safety member, and a longitudinal rod portion extending perpendicularly from said traverse plate in said longitudinal direction; and said resilient member is configured as a coiled compression spring sleeved on said longitudinal rod portion of said second safety member between said spring-engaging plate portions of said first and second safety members.

* * * * *